US012455128B2

(12) United States Patent
Puha

(10) Patent No.: US 12,455,128 B2
(45) Date of Patent: Oct. 28, 2025

(54) KINETIC DELAY OPERATING SYSTEM FOR RECOIL FIREARMS

(71) Applicant: Eight Holdings LLC, Coeur D'Alene, ID (US)

(72) Inventor: Teodor Puha, Coeur D'Alene, ID (US)

(73) Assignee: EIGHT HOLDINGS LLC, Coeur D'Alene, ID (US)

( * ) Notice: Subject to any disclaimer, the term of this patent is extended or adjusted under 35 U.S.C. 154(b) by 93 days.

(21) Appl. No.: 18/587,748

(22) Filed: Feb. 26, 2024

(65) Prior Publication Data

US 2025/0164200 A1 May 22, 2025

Related U.S. Application Data

(60) Provisional application No. 63/618,709, filed on Jan. 8, 2024, provisional application No. 63/448,306, filed on Feb. 26, 2023.

(51) Int. Cl.

| | |
|---|---|
| ***F41A 5/16*** | (2006.01) |
| ***F41A 3/26*** | (2006.01) |
| ***F41A 3/82*** | (2006.01) |
| ***F41A 3/86*** | (2006.01) |

(52) U.S. Cl.
CPC . *F41A 3/86* (2013.01); *F41A 3/26* (2013.01)

(58) Field of Classification Search
CPC ..... F41A 5/14; F41A 5/16
See application file for complete search history.

(56) References Cited

U.S. PATENT DOCUMENTS

| | | | | | |
|---|---|---|---|---|---|
| 663,955 | A * | 12/1900 | Burgess | F41A 3/16 | 42/11 |
| 1,337,444 | A * | 4/1920 | Douglas | F41A 19/27 | 89/151 |
| 1,429,370 | A * | 9/1922 | Putnam | F41A 5/16 | 89/33.14 |
| 1,519,806 | A * | 12/1924 | Wesson | F41A 9/47 | 42/11 |
| 2,436,175 | A * | 2/1948 | Neal | F41A 17/56 | 42/71.01 |
| 2,628,536 | A * | 2/1953 | Schaich | F41A 3/44 | 89/137 |
| 3,020,662 | A * | 2/1962 | Merkel | F41A 19/39 | 42/69.01 |
| 4,019,423 | A * | 4/1977 | Johnson | F41A 21/12 | 89/197 |

(Continued)

*Primary Examiner* — Derrick R Morgan
(74) *Attorney, Agent, or Firm* — Eric B. Fugett; Mark A. Pitchford; Pitchford Fugett, PLLC

(57) ABSTRACT

A gun includes a kinetic delay to reduce total recoil energy transferred to a shooter and extend the time of the recoil impulse to reduce felt recoil and increase controllability. In one embodiment, a bolt of a gun is longitudinally separated from a bolt carrier of the gun such that there is a delay between firing the gun and the bolt longitudinally impacting the bolt carrier. In one embodiment, the barrel is longitudinally separated from the bolt carrier such that the barrel longitudinally impacts the bolt carrier before the barrel longitudinally impacts a barrel stop of the gun when the gun is fired. In one embodiment, a locking bolt includes a bolt pin extending through a bolt pin slot in the bolt carrier and the bolt pin slot is elongated such that the bolt pin does not contact either end of the bolt pin slot when the gun is cycled.

17 Claims, 11 Drawing Sheets

(56) References Cited

U.S. PATENT DOCUMENTS

| | | | | | |
|---|---|---|---|---|---|
| 4,028,994 | A * | 6/1977 | Ferluga | F41A 5/16 | 89/161 |
| 4,061,075 | A * | 12/1977 | Smith | F41A 15/00 | 42/25 |
| 4,677,897 | A * | 7/1987 | Barrett | F41A 19/30 | 89/198 |
| 4,867,040 | A * | 9/1989 | Barrett | F41A 5/08 | 89/169 |
| 5,123,329 | A * | 6/1992 | Irwin | F41A 9/47 | 89/14.3 |
| 5,939,659 | A * | 8/1999 | Dobbins | F41A 5/16 | 89/187.01 |
| 6,405,631 | B1 * | 6/2002 | Milek | F41A 5/20 | 89/145 |
| 7,231,864 | B2 * | 6/2007 | Ratti | F41A 5/20 | 89/159 |
| 7,568,422 | B1 * | 8/2009 | Barrett | F41A 3/26 | 89/190 |
| 11,698,239 | B2 * | 7/2023 | Puha | F41C 23/16 | 42/76.01 |
| 12,209,831 | B2 * | 1/2025 | Sun | F41A 15/14 | |
| 2020/0292254 | A1 * | 9/2020 | Overstreet | F41A 19/30 | |
| 2022/0214129 | A1 * | 7/2022 | Puha | F41C 23/16 | |
| 2025/0060180 | A1 * | 2/2025 | Puha | F41A 3/66 | |

* cited by examiner

KINETIC DELAY OPERATING SYSTEM FOR RECOIL FIREARMS

CROSS-REFERENCE TO RELATED APPLICATIONS

This application claims priority to U.S. Provisional Patent Application No. 63/448,306 entitled "KINETIC DELAYED BLOWBACK OPERATING SYSTEMS FOR FIREARMS" filed on Feb. 26, 2023. This application claims priority to U.S. Provisional Patent Application No. 63/618,709 entitled "KINETIC DELAY OPERATING SYSTEM FOR RECOIL FIREARMS" filed Jan. 8, 2024.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FEDERALLY SPONSORED RESEARCH AND DEVELOPMENT

Not Applicable

BACKGROUND OF THE INVENTION

The present invention relates generally to guns. More particularly, this invention pertains to reducing a recoil impulse in guns.

Energy is transferred into a shooter when a projectile is launched from a gun. The transfer of energy into the shooter over time is the recoil impulse of the gun. Manually reloading guns such as bolt action, single shot, pump action, and break action guns have the most felt recoil for a given load. Reducing the total energy transferred to the shooter and extending the energy transferred to the shooter over time reduces the felt recoil and make the gun more comfortable for the shooter. Gas operated semi-automatic and fully automatic use barrel pressure to cycle the gun which reduces total energy transferred as well as increasing the time to transfer the energy which reduces the felt recoil. Short and long recoil guns, as well as blowback guns, use recoil energy from firing the gun to cycle the action of the gun which decreases the total recoil energy transferred to the shooter and may slightly increase the time to transfer the recoil energy to the shooter.

SUMMARY OF THE INVENTION

Aspects of the present invention provide a gun utilizing a kinetic delay system to both reduce total recoil energy transferred to a shooter and extend the time of the recoil impulse to reduce felt recoil and increase the shooter's ability to control the gun during rapid firing of the gun. In one embodiment, a bolt of a gun is longitudinally separated from a bolt carrier of the gun such that there is a delay between firing the gun and the bolt longitudinally impacting the bolt carrier to cycle the gun. In one embodiment, the barrel reciprocates, and the barrel is longitudinally separated from the bolt carrier such that the barrel longitudinally impacts the bolt carrier before the barrel longitudinally impacts a barrel stop of the gun when the gun is fired. In one embodiment, the gun includes a locking bolt including a bolt pin extending through a bolt pin slot in the bolt carrier and the bolt pin slot is elongated such that the bolt pin does not contact either end of the bolt pin slot when the gun is cycled.

BRIEF DESCRIPTION OF DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
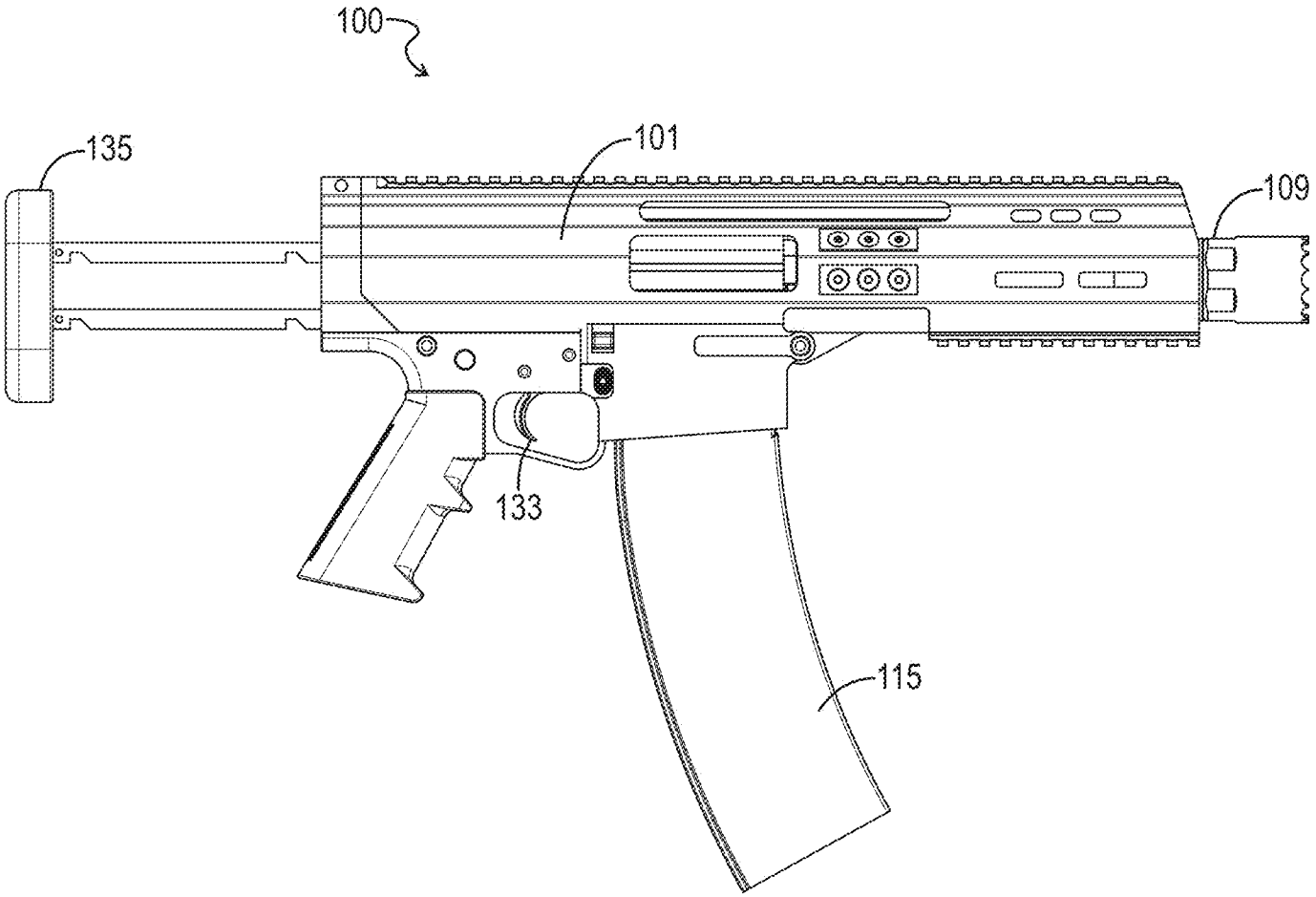
FIG. 1 is a side plan view of a gun in an upright position according to one embodiment of the invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein an upright position of a gun is when held ready for firing in a horizontal direction with a trigger extending generally downward from a longitudinal axis of the barrel of the gun. A gun has a longitudinal axis collinear with a center of a bore of the barrel of the gun. A longitudinal direction is parallel to this longitudinal axis. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

The terms "coupled" and "connected" mean at least either a direct electrical or mechanical connection between the connected items or an indirect connection through one or more passive or active intermediary devices.

Figure 2:
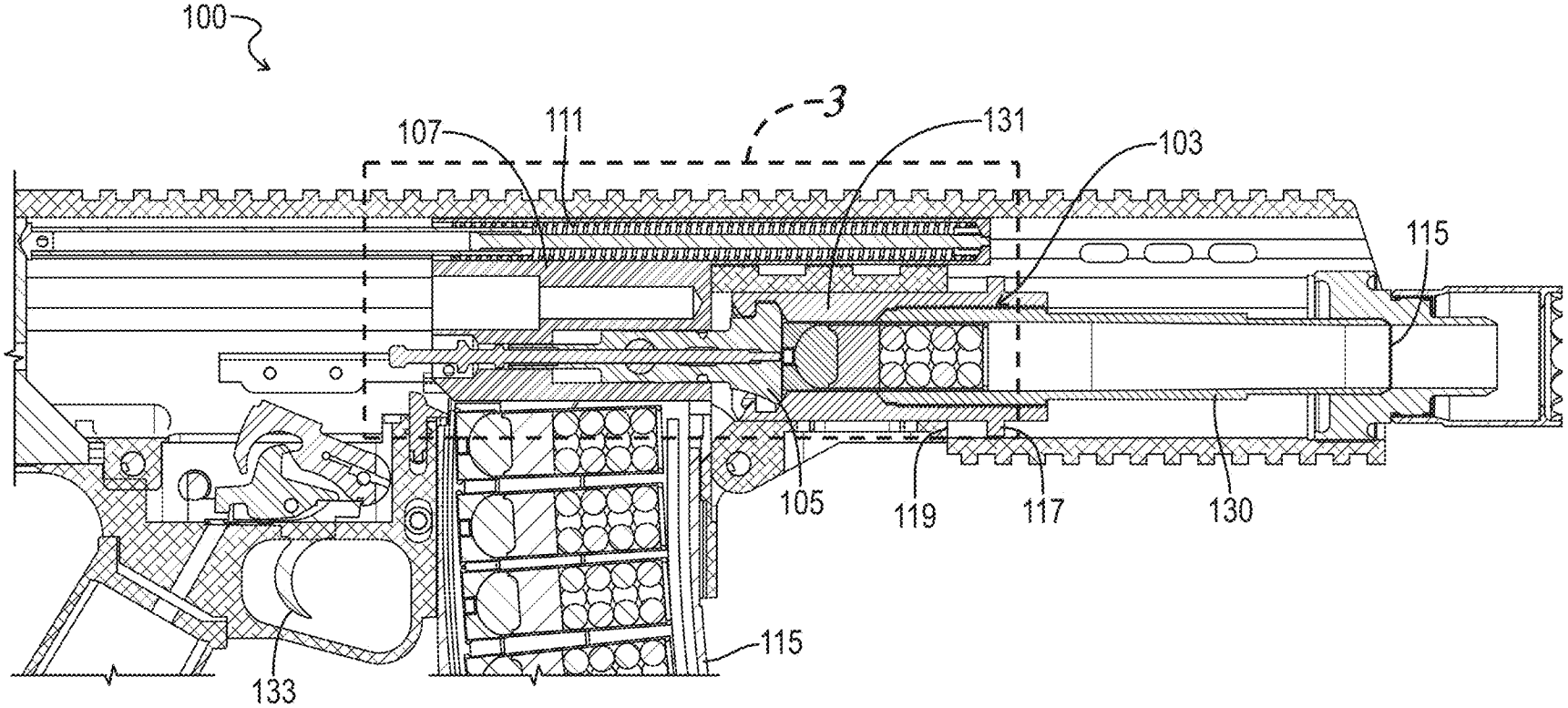
FIG. 2 is a right side cutaway view of the gun of FIG. 1.
Figure 3:
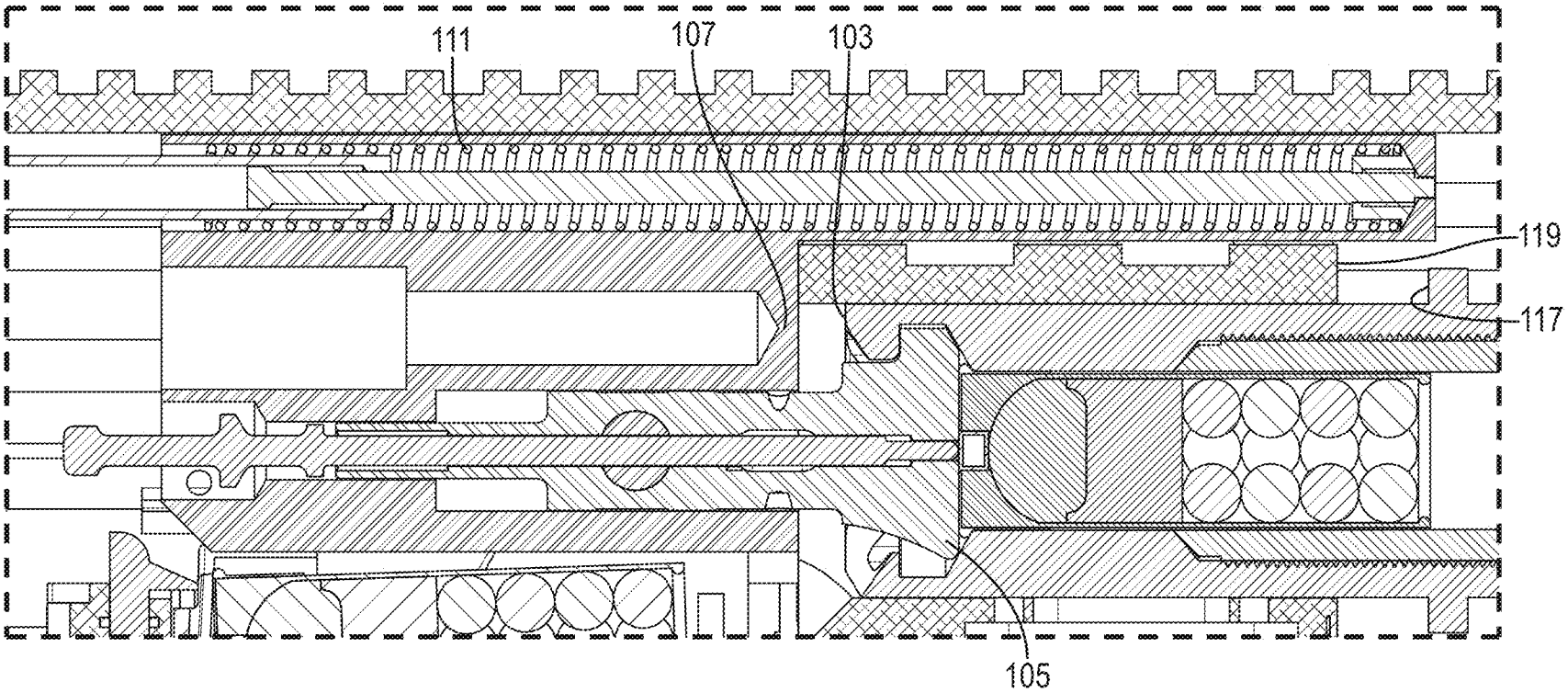
FIG. 3 is a right side cutaway view of the gun of FIG. 1 showing spacing between the barrel shoulder and barrel stop and the barrel and bolt carrier.
Figure 4:
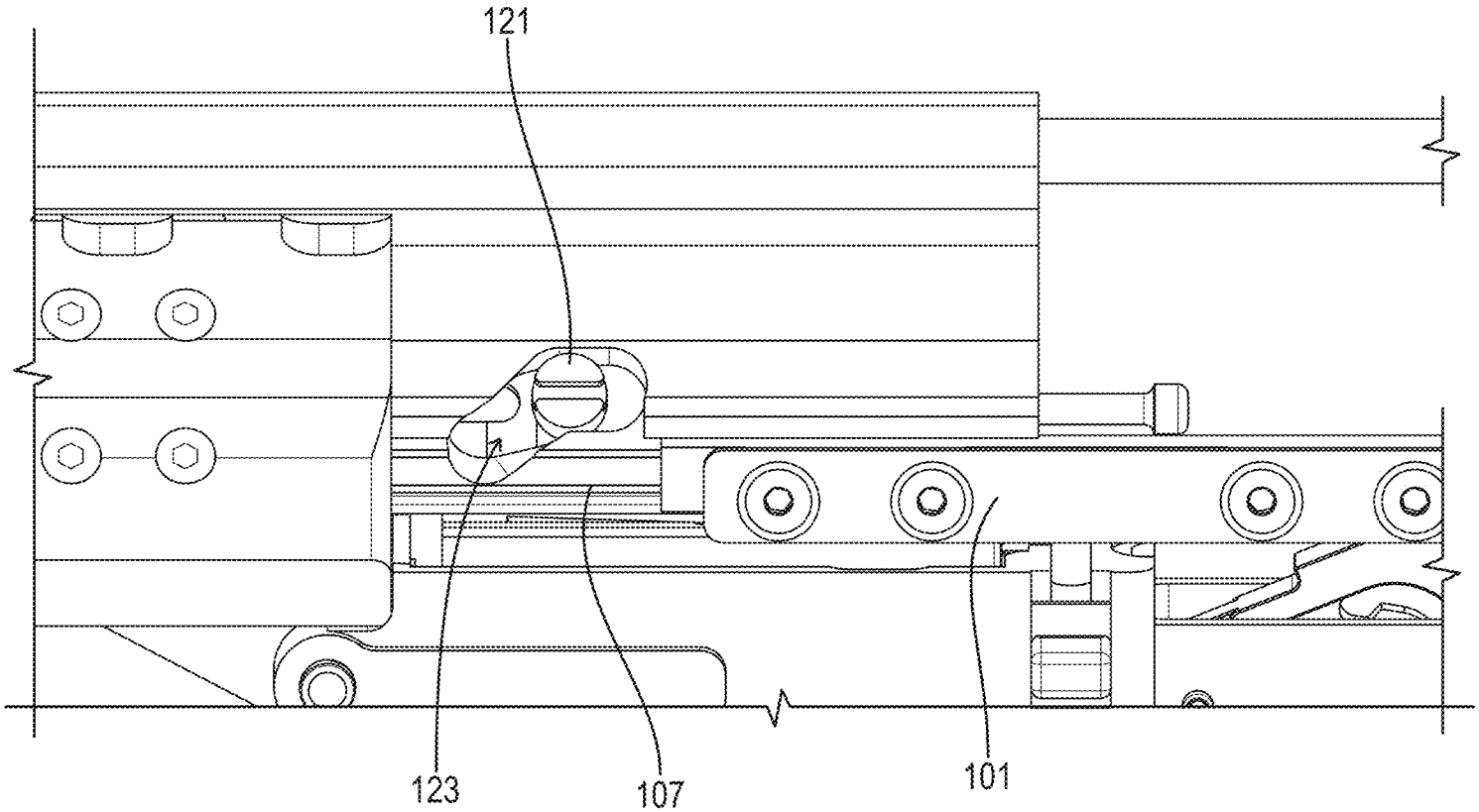
FIG. 4 is a left side cutaway view of the gun of FIG. 1 showing the cam pin in the cam pin slot when the gun is ready to be fired (i.e., in battery).
Figure 5:
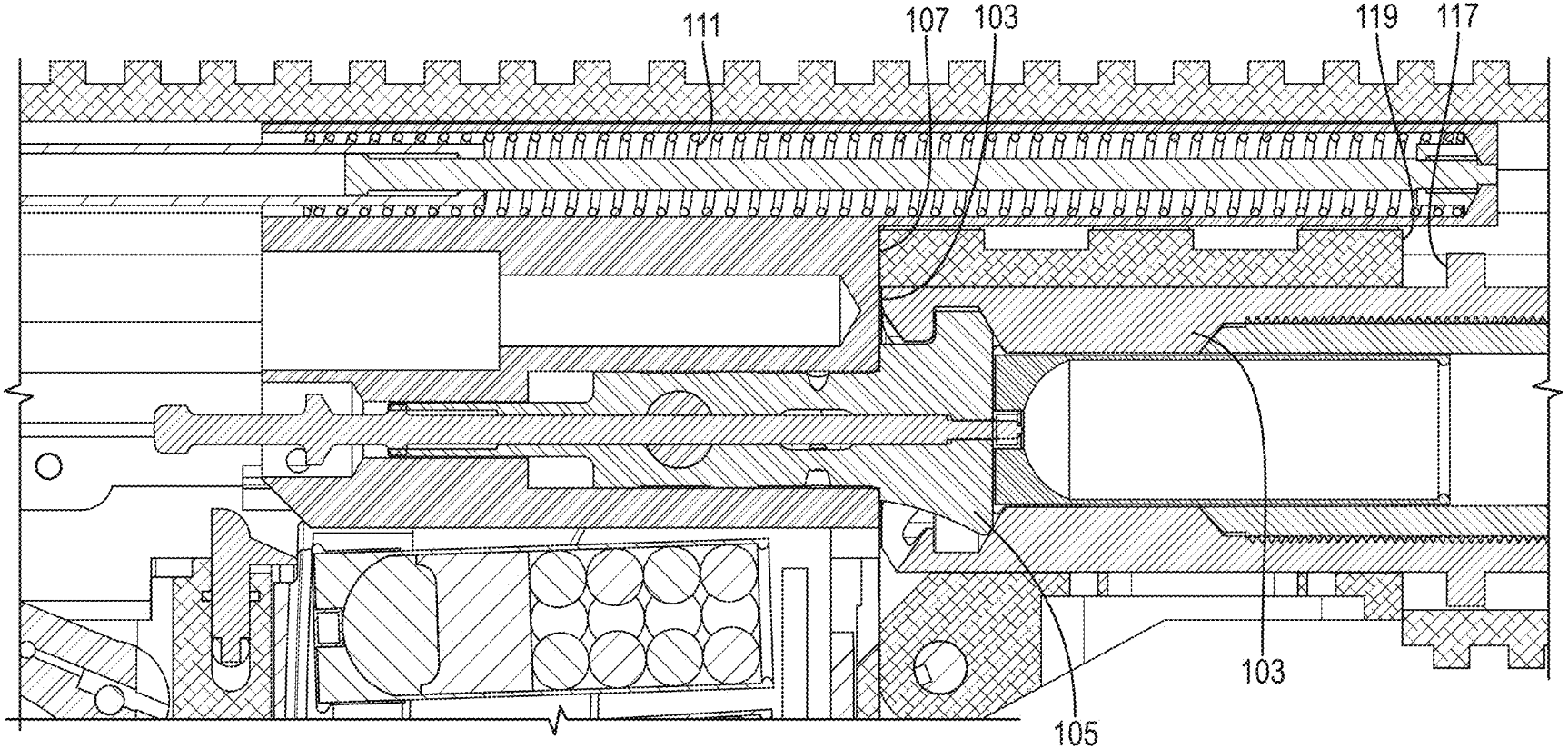
FIG. 5 is a right side cutaway view of the gun of FIG. 1 showing the barrel contacting the bolt carrier upon firing the gun.
Figure 6:
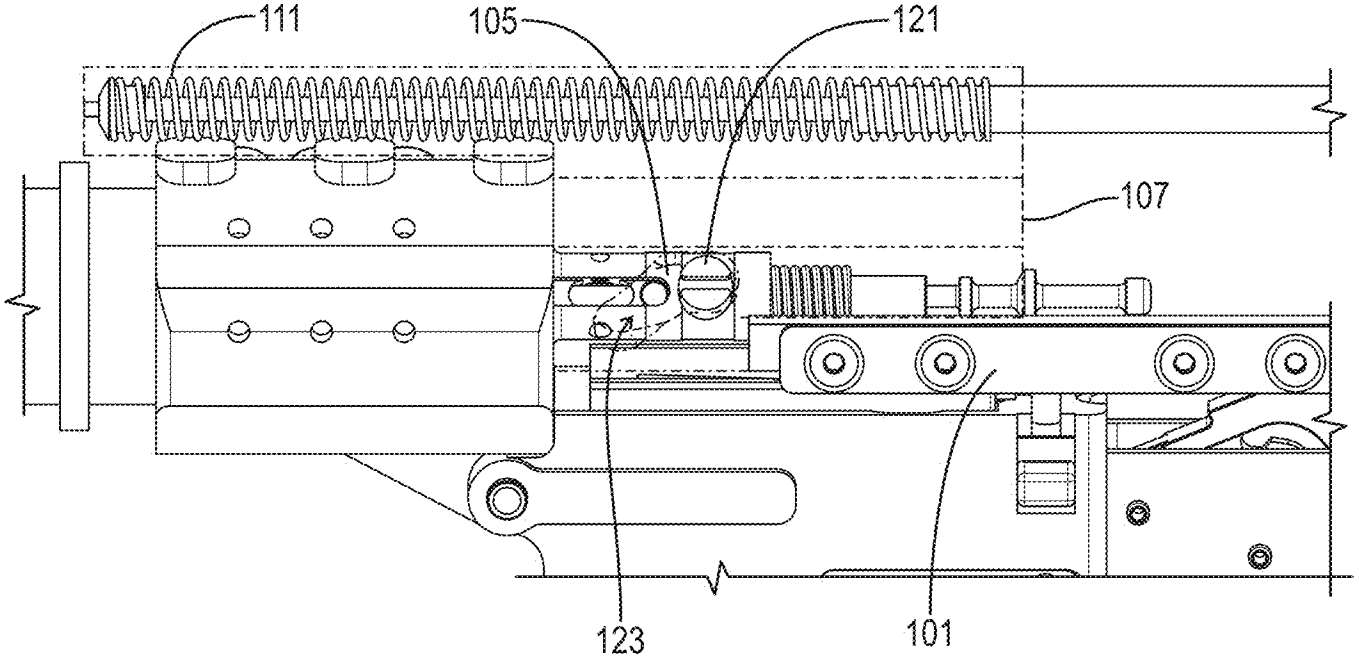
FIG. 6 is a left side cutaway view of the gun of FIG. 1 showing the cam pin in the cam pin slot when the barrel contacts the bolt carrier and space remaining between the rear of the slot and the cam pin.
Figure 7:
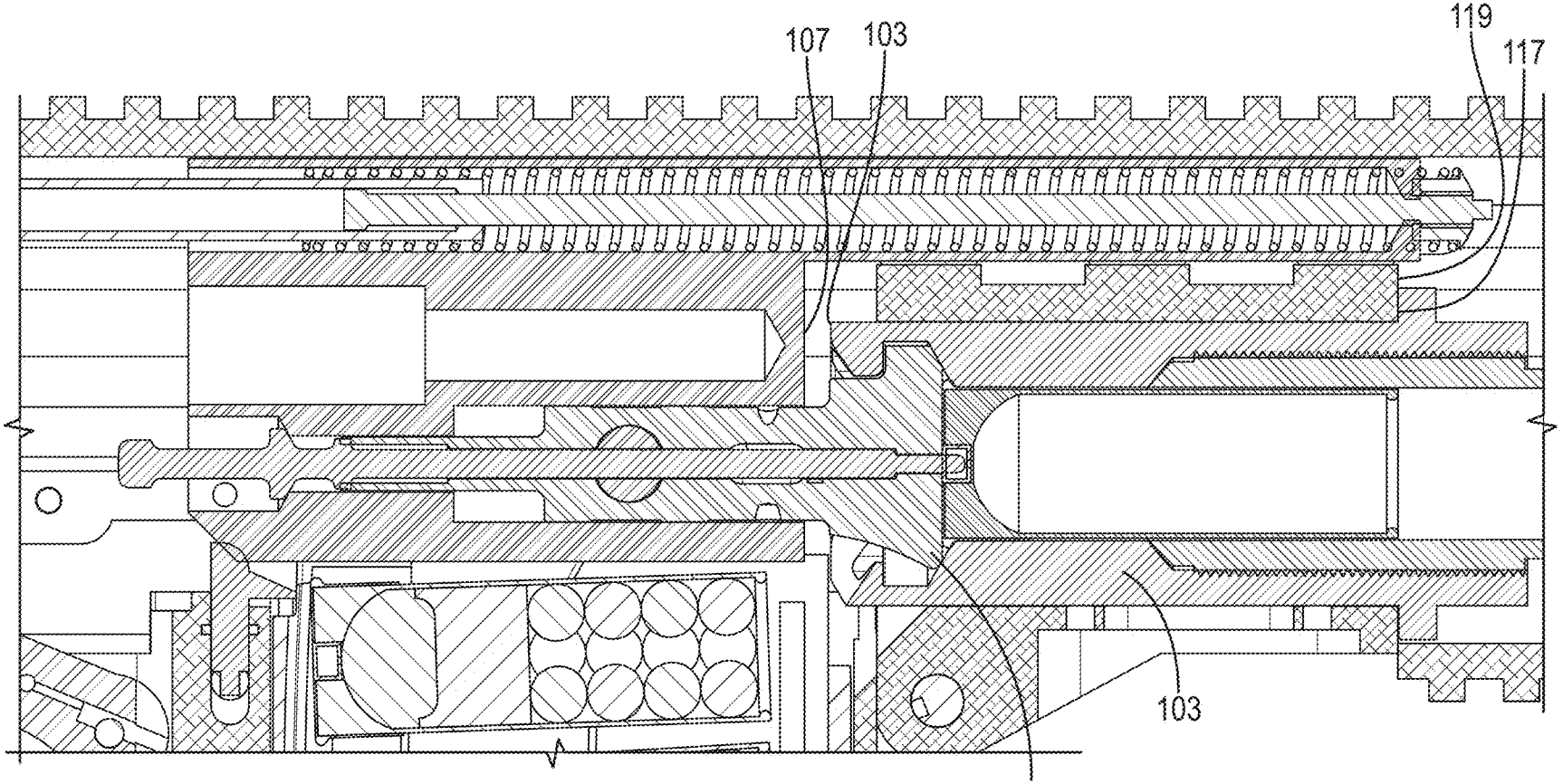
FIG. 7 is a right side cutaway view of the gun of FIG. 1 showing the barrel in a rearward position and the bolt carrier moving rearward to separate from the barrel.
Figure 8:
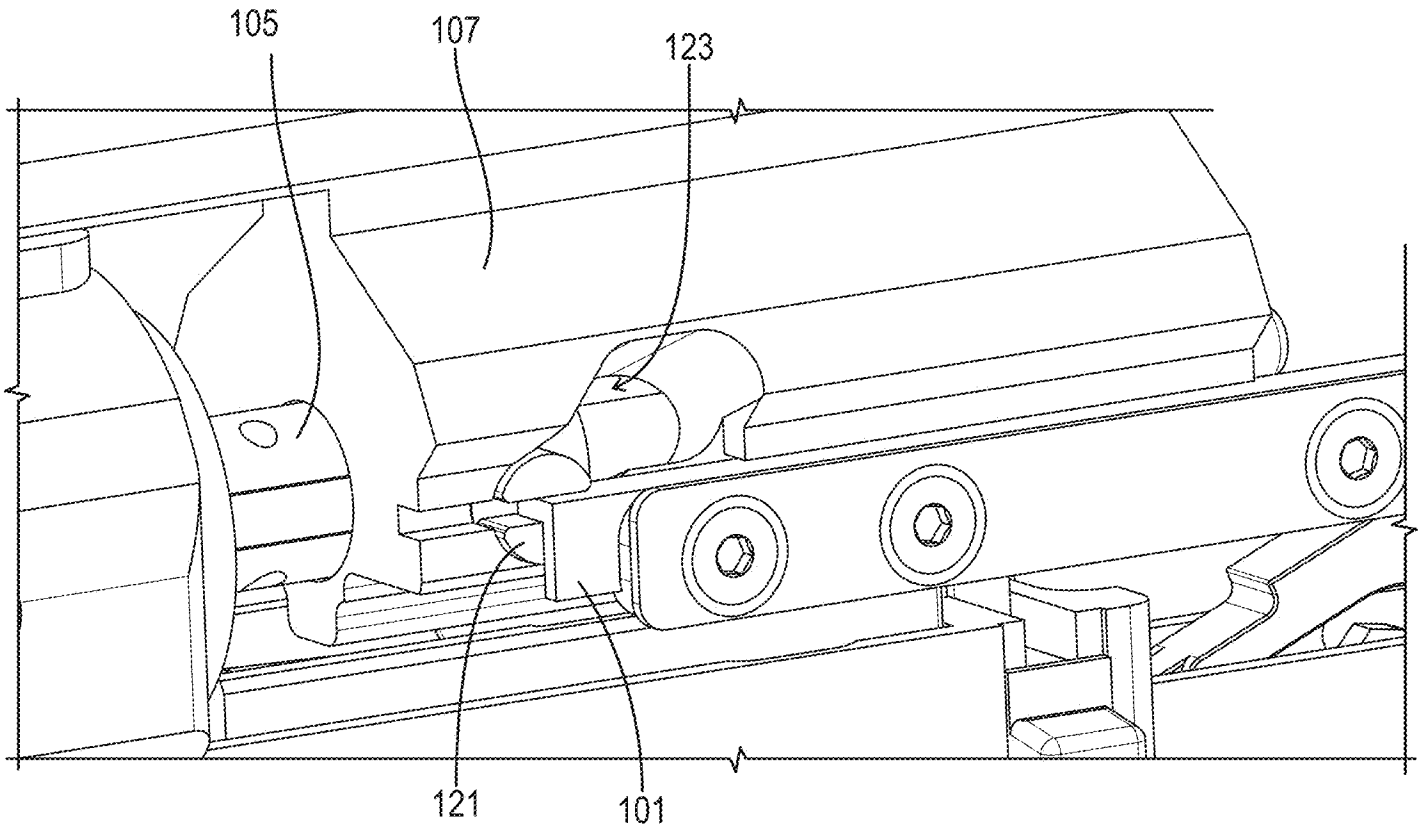
FIG. 8 is a left side cutaway view of the gun of FIG. 1 showing the cam pin in the cam pin slot when the barrel contacts the bolt carrier and space remaining between the front of the slot and the cam pin as the bolt disengages the barrel and continues moving rearward to cycle the gun and load a new round from the magazine.
Figure 9:
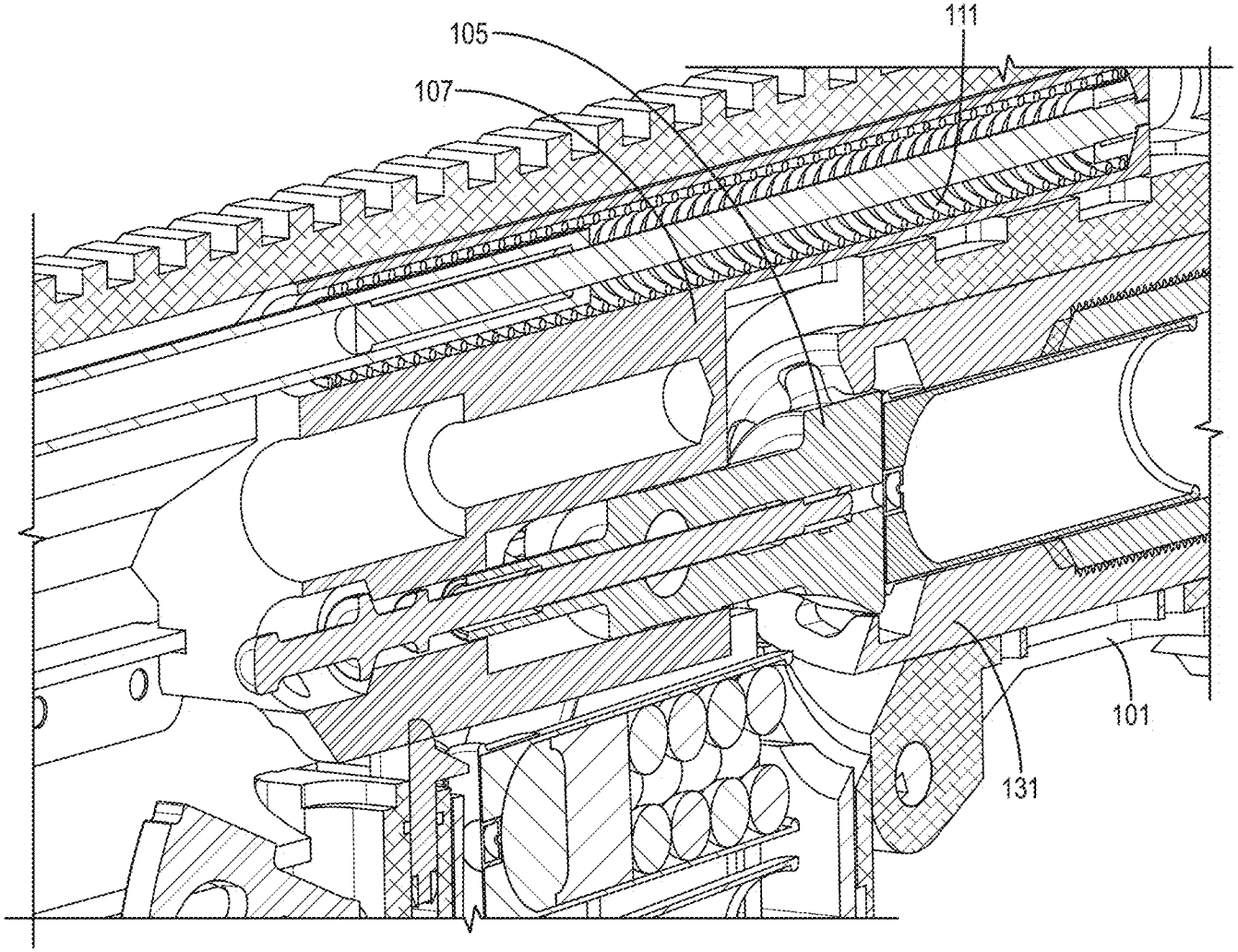
FIG. 9 is a right side isometric cutaway view of the gun of FIG. 1 showing the barrel in a rearward position and the bolt carrier moving rearward to separate from the barrel with the lugs of the bolt disengaging the corresponding lugs of the barrel.
Figure 10:
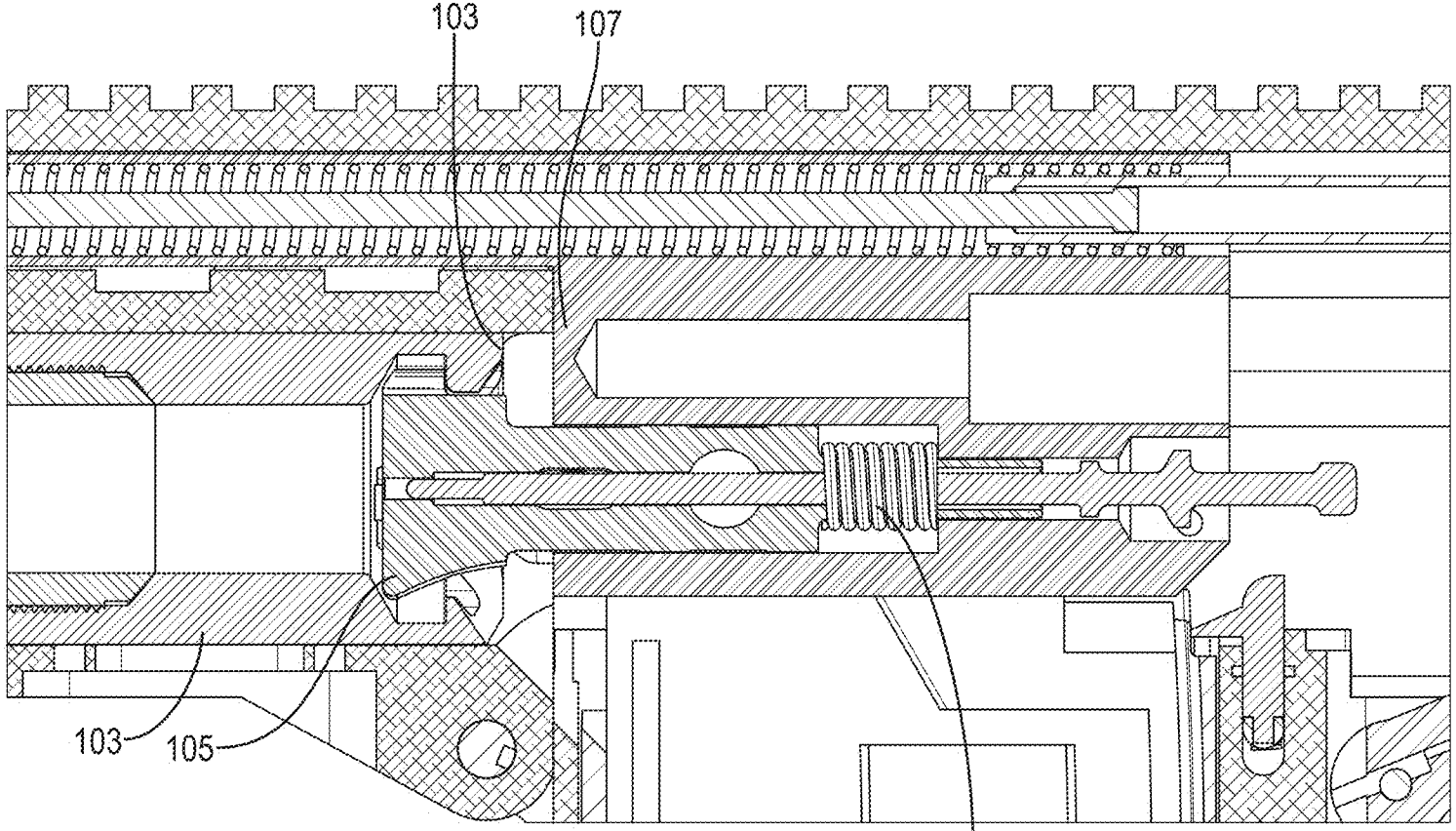
FIG. 10 is a left side cutaway view of a gun including a bolt spring separating the bolt from the bolt carrier when the bolt and bolt carrier are in the forward position.
Figure 11:
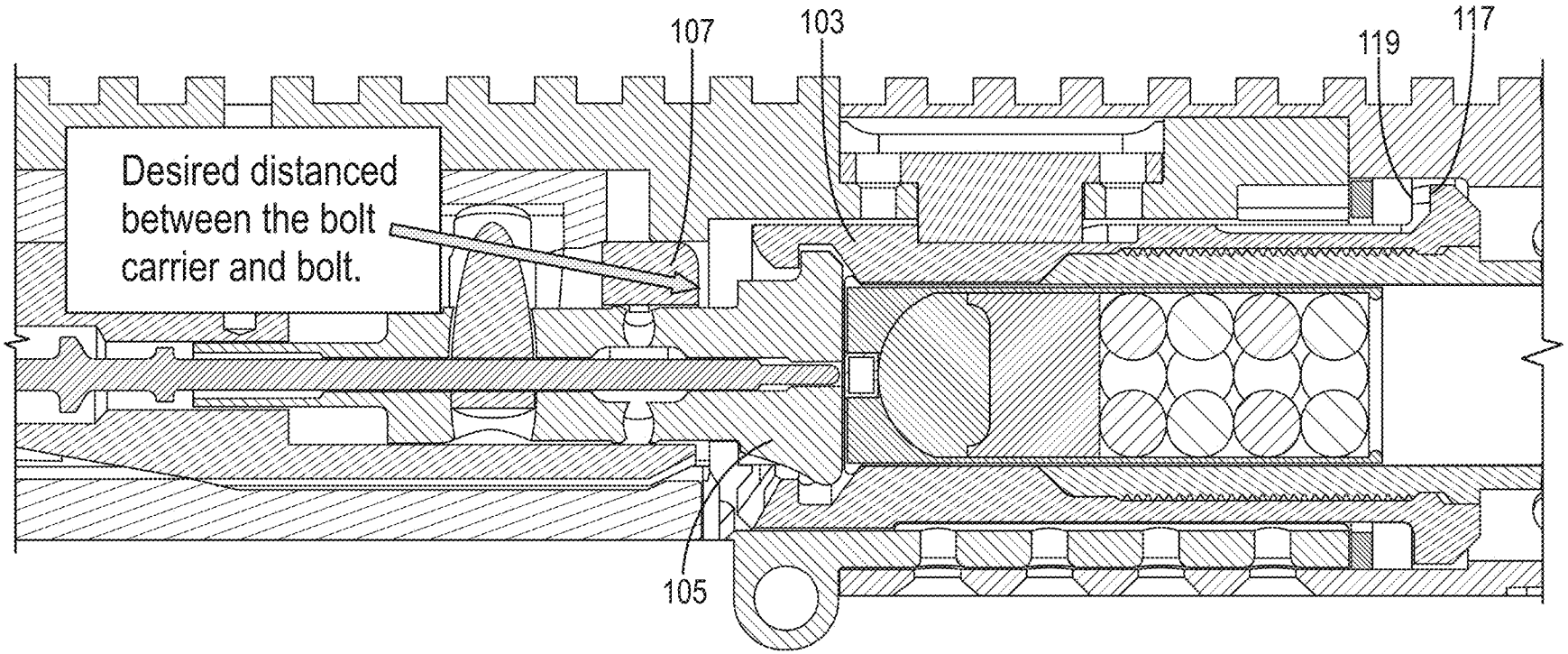
FIG. 11 is a right side cutaway of the gun of FIG. 10 showing longitudinal separation between the bolt and bolt carrier and the barrel shoulder and the barrel stop.

Referring now to FIGS. 1-11, a gun 100 includes a receiver 101, a barrel 103, a bolt 105, and a bolt carrier 107. The barrel 103 extends longitudinally and includes a muzzle 109 at a forward end of the barrel 103. That is, a bore of the barrel 103 defines a longitudinal axis, and all directions parallel to the longitudinal axis are considered to be "longitudinal."

The bolt 105 is biased to a forward position of the bolt 105. In the forward positon of the bolt 105, the bolt 105 is in contact with the barrel 105. In one embodiment, the bolt 105 is biased to the forward position by a bolt spring 113 between the bolt carrier 107 and the bolt 105 and an action spring 113 biasing the bolt carrier 107 forward.

The bolt carrier 107 is biased toward a forward position of the bolt carrier 107 by the action spring 111. The action spring 111 may be located rearward of the bolt carrier 107, or the bolt carrier 107 may include an arm extending radially outward (i.e., generally perpendicular to longitudinal) from the bolt to engage the action spring 111 such that the action spring 111 may be above, below, or to the side of the bolt carrier 107. The bolt carrier 107 is configured to convey the bolt 105 to a rear position of the bolt 105 when the gun 100 is fired and return the bolt 105 to the forward position of the bolt 105 to complete a cycle of the gun. Typically, the bolt 105 will return to the forward position after stripping a new round from a magazine 115 of the gun 100 to reload the gun 100. The magazine 115 may be magazine tube, a detachable box magazine 115, an internal magazine, or any other type of magazine. Alternatively, the gun 100 may be fed ammunition from belted ammunition.

In one embodiment, the bolt 105 is longitudinally separated from the bolt carrier 107 in the forward positon of the bolt 105. In one embodiment, the bolt carrier 107 supports the bolt 105 vertically and horizontally when the bolt 105 is in the forward position, and throughout cycling of the bolt 105 or gun 100 when the gun 100 is fired. When the gun 100 is fired, the bolt 105 moves longitudinally rearward relative to the bolt carrier 107 to impact the bolt carrier 107 and impart rearward energy to the bolt carrier 107, moving the bolt carrier 107 and bolt 105 to a rearward position before the action spring 111 and bolt spring 113 return the bolt carrier 107 and bolt 105 to the forward position (i.e., in battery and ready to fire another round or shell of ammunition).

In one embodiment, the bolt 105 is locked up to the barrel 103 via corresponding lugs at the bolt face and the rear of the barrel 103 when the bolt 105 is in the forward position of the bolt 105. The bolt 105 travels longitudinally rearward with the barrel 103 until the bolt is unlocked from the barrel 103, typically by a slight rotation of the bolt 105. In one embodiment, the bolt 105 includes a bolt cam pin 121 extending radially outward from the bolt through a cam pin slot 123 in the bolt carrier 107. The shape of the cam pin slot 123 is configured to rotate the bolt 103 via the cam pin 121 as the gun 100 cycles upon firing the gun 100 such that the bolt 103 locks and unlocks from the barrel 103 during cycling. In one embodiment, the cam pin slot 123 is helical and elongated such that the cam pin 121 does not contact the front or rear of the cam pin slot 123. The cam pin 121 does not contact the front or rear of the cam pin slot at the forward position of the bolt 103 or the rear position of the bolt 105.

In one embodiment, the barrel 103 is biased to a forward position thereof (e.g., by the action spring 111 and, optionally, bolt spring 113). The barrel 103 is configured to move longitudinally rearward relative to the receiver 101 when the gun 100 is fired (e.g., as the gun cycles). The barrel 103 includes a barrel shoulder 117 rearward of the muzzle 109. The gun 100 includes a barrel stop 119 configured to limit rearward longitudinal travel of the barrel 103 relative to the receiver 101 by contacting the barrel shoulder 117 of the barrel 103 when the barrel moves rearward to a rear position of the barrel when the gun 100 is fired. The barrel shoulder 117 is longitudinally separated from the barrel stop 119 by a first predetermined distance when the barrel 103 is in the forward position. The barrel 103 is longitudinally separated from the bolt carrier 107 by a second predetermined distance less than the first predetermined distance. Thus, when the gun 100 is fired, the barrel 103 impacts the bolt carrier 107 to impart rearward longitudinal momentum or energy into the bolt carrier 107 before the barrel shoulder 117 longitudinally impacts the barrel stop 119, transferring any remaining energy to the barrel stop 119. In one embodiment, the barrel stop 119 is integral with the receiver 101, and the receiver 101 supports the barrel 103 vertically and horizontally while the barrel 103 reciprocates after firing the gun 100, during cycling of the gun 100. A rear position of the barrel 103 is when the barrel shoulder is against the barrel stop 119.

In one embodiment, the barrel 103 includes a barrel tube 130 and a barrel extension 131. The barrel tube 130 is affixed to the barrel extension 131 when the gun 100 is assembled. The barrel tube 130 extends forward from the barrel extension 131 when the gun 100 is assembled. The bolt 103 has lugs that locks up to lugs in the barrel extension 131 when the bolt 103 is in the forward position (i.e., in battery or ready to fire).

In one embodiment, the gun 100 is ready to fire or in battery (assuming a round or shell is in the chamber or barrel 103 of the gun 100) when the bolt 105 is in the forward position, the bolt carrier 107 is in the forward position, and the barrel 103 is in the forward position. The action spring 111, and optionally, a bolt spring 113 is configured to bias the bolt carrier 107, bolt 105, and barrel 103 into their respective forward positions. The barrel 103 is biased forward by pressure from the bolt 105. In one embodiment, after firing, the bolt 105 locks up to the barrel 103 as the bolt 103 pushes the barrel from the rear position of the barrel 103 to the forward position of the barrel 103.

In one embodiment, the gun 100 further includes a trigger 133 (e.g., trigger group) configured to receive input from a user or shooter of the gun 100 to fire the gun 100. The gun 100 will only fire in response to receiving input from the user at the trigger when a round of ammunition is in the barrel 103 and the bolt 105 is in the forward position. In one embodiment, the gun 100 further includes the magazine 115 and a butt stock 135. The magazine 115 is configured to provide a round of ammunition to the barrel 103 when the gun 100 is fired and cycles. The butt stock 135 extends rearward from the receiver 101 when the gun 100 is assembled.

As used herein, a gun may be any projectile launching device such as a shotgun, rifle, airgun, or grenade launcher. Embodiments of the invention disclosed herein include short and long recoil guns as well as blowback operated guns (i.e., guns with non-locking bolts).

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful KINETIC DELAY OPERATING SYSTEM FOR RECOIL FIREARMS it is not intended that such references be construed as limitations upon the scope of this invention except as set forth in the following claims.

What is claimed is:

1. A gun comprising:

a receiver;

a barrel biased toward a forward position thereof, wherein:

the barrel is configured to move longitudinally rearward relative to the receiver when the gun is fired, the barrel comprises a muzzle at a forward end thereof, and the barrel comprises a barrel shoulder rearward of the muzzle;

a barrel stop configured to limit rearward longitudinal travel of the barrel relative to the receiver by contacting the barrel shoulder of the barrel when the barrel moves rearward when the gun is fired;

a bolt biased toward a forward position thereof, wherein:

the bolt is locked up to the barrel when the bolt is in the forward position, and the bolt travels longitudinally rearward from the forward position with the barrel when the gun is fired until the bolt is unlocked from the barrel; and a bolt carrier configured to convey the bolt to a rear position of the bolt when the gun is fired and return the bolt to the forward position of the bolt; wherein:

the barrel shoulder is longitudinally separated from the barrel stop by a first predetermined distance when the barrel is in a forward position of the barrel; and the barrel is longitudinally separated from the bolt carrier by a second predetermined distance less than the first predetermined distance when the bolt carrier is in a forward position thereof and the barrel is in the forward position;

a rear position of the barrel is when the barrel shoulder is against the barrel stop; and after firing, the bolt locks up to the barrel as the bolt pushes the barrel from the rear position of the barrel to the forward position of the barrel.

2. The gun of claim 1, wherein:

the barrel comprises a barrel extension and a barrel tube;

the barrel tube is affixed to the barrel extension when the gun is assembled;

the barrel tube is configured to extend longitudinally forward from the barrel extension; and the bolt locks up to the barrel extension.

3. The gun of claim 1, wherein:

the barrel stop is integral with the receiver; and when fired, the barrel longitudinally impacts the bolt carrier before the barrel shoulder longitudinally impacts the barrel stop.

4. The gun of claim 1, wherein:

the bolt comprises a cam pin extending radially outward from the bolt; and the bolt carrier comprises a helical cam pin slot configured to receive the cam pin and rotate the bolt during cycling of the gun to unlock and lock the bolt to the barrel, said helical cam pin slot extending longitudinally beyond the cam pin such that the cam pin does not contact a front or a rear of the helical cam pin slot.

5. The gun of claim 1, wherein:

the gun further comprises an action spring configured to bias the bolt carrier forward which biases the bolt to the forward position of the bolt and the barrel to the forward position of the barrel.

6. The gun of claim 1, wherein:

prior to firing the gun, the bolt is in the forward position thereof;

prior to firing the gun, the bolt carrier is in the forward position thereof; and prior to firing the gun, the barrel is in the forward position thereof.

7. The gun of claim 1, wherein:

the gun further comprises a trigger configured to receive input from a user to fire the gun; and the gun will only fire in response to receiving input from the user at the trigger when a round of ammunition is in the barrel and the bolt is in the forward position.

8. The gun of claim 1, wherein:

the gun further comprises a magazine configured to provide a round of ammunition to the barrel when the gun is fired; and the gun further comprises a butt stock extending rearward from the receiver when the gun is assembled.

9. A gun comprising:

a receiver;

a barrel biased toward a forward position thereof, wherein:

the barrel is configured to move longitudinally rearward relative to the receiver when the gun is fired, the barrel comprises a muzzle at a forward end thereof, and the barrel comprises a barrel shoulder rearward of the muzzle;

a barrel stop configured to limit rearward longitudinal travel of the barrel relative to the receiver by contacting the barrel shoulder of the barrel when the barrel moves rearward when the gun is fired;

a bolt biased toward a forward position thereof, wherein:

the bolt engages the barrel when the bolt is in the forward position, and the bolt travels longitudinally rearward from the forward position with the barrel when the gun is fired until the bolt disengages from the barrel; and a bolt carrier configured to convey the bolt to a rear position of the bolt when the gun is fired and return the bolt to the forward position of the bolt; wherein:

the barrel shoulder is longitudinally separated from the barrel stop by a first predetermined distance when the barrel is in a forward position of the barrel;

the barrel is longitudinally separated from the bolt carrier by a second predetermined distance less than the first predetermined distance when the bolt carrier is in a forward position thereof and the barrel is in the forward position;

a rear position of the barrel is when the barrel shoulder is against the barrel stop; and after firing, the bolt engages the barrel as the barrel moves from the rear position of the barrel to the forward position of the barrel.

10. The gun of claim 9, wherein:

the bolt comprises a cam pin extending radially outward from the bolt; and the bolt carrier comprises a helical cam pin slot configured to receive the cam pin and rotate the bolt during cycling of the gun to unlock and lock the bolt to the barrel, said helical cam pin slot extending longitudinally beyond the cam pin such that the cam pin does not contact a front or a rear of the helical cam pin slot.

11. The gun of claim 9, wherein:

the barrel comprises a barrel extension and a barrel tube;

the barrel tube is affixed to the barrel extension when the gun is assembled;

the barrel tube is configured to extend longitudinally forward from the barrel extension; and the bolt engages the barrel extension.

12. The gun of claim 11, wherein the bolt locks up to the barrel extension.

13. The gun of claim 9, wherein:

the barrel stop is integral with the receiver; and when fired, the bolt longitudinally impacts the bolt carrier before the barrel shoulder longitudinally impacts the barrel stop.

14. The gun of claim 9, wherein:

the gun further comprises an action spring configured to bias the bolt carrier forward which biases the bolt to the forward position of the bolt and the barrel to the forward position of the barrel.

15. The gun of claim 14, wherein:

the gun further comprises a bolt spring configured to bias the bolt longitudinally forward relative to the bolt carrier.

16. The gun of claim 9, wherein:

prior to firing the gun, the bolt is in the forward position thereof;

prior to firing the gun, the bolt carrier is in the forward position thereof; and prior to firing the gun, the barrel is in the forward position thereof.

17. The gun of claim 9, wherein:

the gun further comprises a trigger configured to receive input from a user to fire the gun;

the gun will only fire in response to receiving input from the user at the trigger when a round of ammunition is in the barrel and the bolt is in the forward position;

the gun further comprises a magazine configured to provide a round of ammunition to the barrel when the gun is fired; and the gun further comprises a butt stock extending rearward from the receiver when the gun is assembled.

* * * * *